US005743127A

United States Patent [19]

Takeda et al.

[11] Patent Number: 5,743,127

[45] Date of Patent: Apr. 28, 1998

[54] ROUND STEEL BAR GUIDE APPARATUS AND METHOD

[75] Inventors: Ryo Takeda; Hidenori Kondo; Yukihiro Hoashi, all of Kurashiki, Japan

[73] Assignee: Kawasaki Steel Corporation, Kobe, Japan

[21] Appl. No.: 580,357

[22] Filed: Dec. 28, 1995

[30] Foreign Application Priority Data

Dec. 28, 1994 [JP] Japan ..... 6-328563
Jul. 31, 1995 [JP] Japan ..... 7-195436

[51] Int. Cl.[6] ..... B21B 30/20

[52] U.S. Cl. ..... 72/250

[58] Field of Search ..... 72/250, 251, 428

[56] References Cited

U.S. PATENT DOCUMENTS

| | | | |
|---|---|---|---|
| 3,765,214 | 10/1973 | Boehmer | 72/250 |
| 4,212,181 | 7/1980 | Smimada | 72/250 |
| 5,363,682 | 11/1994 | Takeda et al. | 72/224 |
| 5,412,970 | 5/1995 | Kawamura et al. | 72/250 |

FOREIGN PATENT DOCUMENTS

| | | |
|---|---|---|
| 2327828 | 5/1977 | France . |
| 1025369 | 3/1958 | Germany . |
| 7415378 | 4/1974 | Germany . |
| 3223667 | 1/1983 | Germany . |
| 1-109309 | 7/1989 | Japan . |
| 1163931 | 6/1985 | U.S.S.R. . |
| 959220 | 5/1964 | United Kingdom . |

*Primary Examiner*—Lowell A. Larson
*Assistant Examiner*—Rodney Butler
*Attorney, Agent, or Firm*—Oliff & Berridge, PLC

[57] ABSTRACT

An apparatus for guiding various sized round steel bars to calibers of rolls while stably holding the round steel bar. The round steel bar can be securely prevented from being twisted with a small amount of a holding force, so that a product with a desirable and accurate dimension can be manufactured. The guide apparatus comprises guide rollers installed at the inlet of at least one of a plurality of multi-roll sizing mills, each stand of which is composed of at least three rolls disposed in a line. The method of guiding the round steel bars comprises a step of elastically holding the free or unrolled surface portion of the round steel bar with a press force in the range of approximately 100 to 500 kg. With the round steel bar guide method and apparatus, a round steel bar is pressed and elastically held on the free surface of the guide apparatus.

20 Claims, 9 Drawing Sheets

ROUND STEEL BAR GUIDE APPARATUS AND METHOD

BACKGROUND OF THE INVENTION

1. Field of the Invention

The invention relates to a round steel bar guide apparatus and its associated method for guiding rolling material, such as a round steel bar, in a sizing mill. More specifically, the round steel bar guide apparatus and its associated method holds various sized round steel bars at an inlet of rolls, and stably guides the round steel bars to calibers of the rolls when a round steel bar is rolled. The rolling mill may, for example, be a three-roll type rolling mill, a four-roll type rolling mill or similar device.

2. Description of the Related Art

Apparatus and methods for sizing rolling material with a round cross-section, for example a round steel bar, steel rod, wire or the like, may be generally classified into either two-roll type, three-roll type or four-roll type rolling mill methods, depending upon the number of rolls used in a stand of a rolling mill. In these methods, a round steel bar is rolled by a pair of rolls over a plurality of paths, while changing the rolling direction. A slightly square and round cross-section round steel bar can be obtained when rolled by the two-roll method. A slightly pentagonal and rounded cross-section round steel bar can be obtained when rolled by the three-roll method. Further, a slightly octagonal and rounded cross-section round steel bar can be obtained when rolled by the four-roll method.

The rolled round steel bars exhibit a cross-sectional difference $\Delta d$ between a maximum diameter $d_1$ and a minimum diameter $d_2$, $\Delta d=d_1-d_2$. In the above methods, when a rolling reduction exceeds a limit, the round steel bar will bulge out of the space between rolls and a faulty unusable product is produced. However, a large rolling reduction results in a wider possible sizing range, which is desirable.

The four-roll method will now be described with reference to FIGS. 8A and 8B. FIG. 8A is a side elevational view of a roll disposition, and FIG. 8B is a front elevational view for the four-roll method. In this method, two sets of four-roll type rolling mills each include four rolls 23A, 23B, 23C and 23D. The four rolls 23A–23D form the pairs of rolls, which are disposed in series as first stand 21 and second stand 22 for sizing a raw round steel bar W from two perpendicular directions. Each of the rolls are spaced apart 45° in a rolling direction between the rolling mills.

Moreover, a four-roll method is preferred because the method results in a smaller width change, and accordingly a smaller width-wise deformation compared to a two-roll method. Further, the four-roll method may result in a product with an increased accuracy. For example, the four-roll rolling mill is known, for example, in U.S. Pat. No. 5,363,682 patented by the instant inventors.

If sizing is conducted using one of the two-roll method, three-roll method or four-roll method, a round steel bar guide apparatus should be disposed at the inlet of a roll stand to properly orient and guide a round steel bar into the calibers of rolls. A conventional roller type guide apparatus 30 is illustrated in FIGS. 9A and 9B. FIG. 9A illustrates a plan view of the conventional guide apparatus and FIG. 9B is a side elevational view. The roller type guide apparatus 30 includes roller holders 33, 33' formed from leaf springs. The leaf springs are mounted symmetrically in a vertical directions on both sides of an opening formed on a main guide body 31. The main guide body 31 has a substantially C-shaped cross-section. Pivot pins 32, 32' and guide rollers 34, 34' are rotatably mounted at extreme ends of the respective roller holders 33, 33', and define confronting roller surfaces. The leaf springs, which form the roller holders 33, 33', usually have a spring constant of 1000 kgf/mm or more.

The roller type guide apparatus 30 is mounted at the inlet of the rolling mill. A round steel bar advances between the guide rollers 34, 34', and is guided to calibers of the rolls. The leaf springs' elastic force presses the guide rollers 34, 34' against the round steel bar. Since various diameter types of round steel bars can be used, the distance between the guide rollers 34, 34' must be adjusted based on size of the round steel bar. The distance between the rolls is adjusted by stopping the rolling mill and manually tightening or loosening upper and lower limit setting adjustment screws 35 and 36, which are axially disposed on the roller mill on opposite sides of the pivot pins 32, 32' for the respective roller holders 33, 33'. When the upper limit setting adjustment screws 35 abut against the main guide body 31, the distance between the guide rollers 34, 34' can not be further increased. Additionally, when the lower limit setting adjustment screws 36 abut against the main guide body 31, the distance between the guide rollers 34, 34' can not be further decreased.

When the distance between the rollers is too narrow, a round steel bar will clog or not pass between the guide rollers 34, 34', and "rolling error" occurs. Conversely, when the distance between the rollers is too wide, a round steel bar cannot be tightly held therebetween. This results in twisting of the round steel bar by rolling, extreme deterioration of the dimensional accuracy, rolling error and the like.

A roller type guide apparatus 30 may be also be installed at the inlet to the rolls in a four-roll type rolling mill. In this case, since the four-roll type rolling mill is preferred, round steel bars having various sizes and dimensions can be rolled with the same rolls, by only changing the distance between the rolls. There is no need to replace the rolls for variations in the round steel bar size.

It is preferable to adjust the distance between the guide rollers without stopping the rolling mill. In this case, an adjustment apparatus may take the form of an expensive remotely-controlled adjustment apparatus, which automatically adjusts the distance between guide rollers using hydraulic mechanisms, or the like, after the round steel bar has passed through the rollers. With an apparatus provided with a remotely-controlled adjustment device, it is not necessary to stop a rolling mill to adjust the distance between the guide rollers 34, 34'. However, the apparatus and the remotely-controlled adjustment device have a very complex structure and is expensive. Thus, this apparatus has a cost, which makes it impractical.

The conventional roller type guide apparatus 30 with the leaf springs exhibits distance adjustment related problems, which will now be summarized. Although the leaf springs that constitute the roller holders 33, 33' have a large spring constant of 1000 kgf/mm or more, the actual distance adjustment between the guide rollers 34, 34' is very delicate. The distance adjustment against the elastic force of the leaf springs is difficult and adjustment error often occurs. Further, the dimensional accuracy will be deteriorated by rolling error and twist due to distance adjustment error.

In an apparatus, which requires manual adjustment of the distance between the guide rollers 34, 34' based on a round steel bar diameter, the rolling mill must be stopped to adjust the distance between the rollers. Thus, when the round steel bar diameter will be often changed, and the production efficiency is greatly lowered.

Japanese Utility Model Publication Laid-Open No. 1-109309 discloses a two-roll type rolling mill apparatus, which includes a roll distance adjustment device and an elastic member for applying tension between roller holders. The apparatus uses a leaf spring, which has a spring constant of 0.92–2.95 kgf/mm, to prevent a faulty rolling material diameter caused by the vibration of the rolling mill on the outlet side, known as "vibration of stock". However, it does not achieve a desirable milling or rolling accuracy because the spring has a very small spring constant, and is not sufficient to draw a pair of guide rollers. Additionally, although the apparatus is provided with a closed side limiting adjustment screw for adjusting a minimum distance between the guide rollers, it does not include an open side limiting adjustment screw for the adjustment of a maximum distance between a pair of the guide rollers. Therefore, the apparatus can not obtain a desirable rolling material accuracy. Further, when a round steel bar is elastically held with a predetermined force, the smaller spring constant requires a larger apparatus, which is inconvenient.

Further, a known multi-roll type guide apparatus 40 for a multi-roll rolling mill is illustrated in FIGS. 10A and 10B. In a four-roll type rolling mill, a guide apparatus guides rolling material, such as a round steel bar W to calibers of rolls, and holds the round steel bar W from the outer peripheral direction by a pair of four guide rolls 41, 42, 43 and 44. Further, FIG. 10B illustrates a known guide apparatus for a three-roll type rolling mill. This guide apparatus guides a round steel bar W to calibers of rolls, while holding the round steel bar W from the outer peripheral direction by three guide rolls 41, 42 and 43.

In the multi-roll type guide apparatus 40, a rolled surface "a" of the bar steel W, which is rolled at a front part of the path, is held by the guide rolls 41, 42, 43 and 44, in each of the two-roll, three roll and four-roll apparatuses. The rolled surface "a" was believed to have been stably held to produce a given shape by the caliber rolls. Further, it was believed that a free surface (unrolled surface) "b" was adequately shaped because it's shape varied depending upon conditions, such as a type of the round steel bar W, rolling temperature, and the like.

However, the conventional method of holding the rolled surface "a" of the round steel bar W increases the number of the rolls needed in a rolling mill. Thus, it is more difficult to adequately hold the round steel bar W because distance $\Delta d$ between the cross-sectional area maximum and minimum size of the round steel bar W is reduced. The round steel bar W could not be properly rolled, and could be subject to twist between rolling mills and a faulty product could result. A further problem could arise in that large, expensive equipment is needed to prevent the above discussed problems.

SUMMARY OF THE INVENTION

One object of the present invention is to solve the above problems found in conventional devices by providing a round steel bar guide apparatus and its associated method that automatically adjusts a distance between guide rollers based on a diameter change of a round steel bar.

Another object of the present invention is to provide a round steel bar guide method and apparatus, which prevents a round steel bar from being twisted and/or damaged.

The inventors have discovered that when a rolling material, such as a round steel bar, is rolled by a three-roll type or four-roll type rolling mill, the resultant peripheries or its circularity is superior to that of a round steel bar rolled by a two-roll method. Further, the instant round steel bar guide apparatus and method are suitable for a three-roll or four-roll sizing mill, even if a guide at the inlet of a round steel bar has a relatively small holding force. Thus, an excellent result can be obtained, regardless of the number of rolls used.

The method for guiding rolling material, such as a round steel bar, of various sizes to calibers of rolls of a rolling mill uses a guide apparatus to hold the round steel bar. The guide apparatus preferably has guide rollers, and is installed at the inlet of at least one of a plurality of multi-roll sizing mills, which may include three or more rolls in series. The method includes the step of elastically holding a free surface of the round steel bar with a force of approximately 100 to 500 kg.

The round steel bar guide apparatus comprises a main guide body having an opening and a substantially C-shaped cross sectional shape; roller holders swingably held at upper and lower portions of the opening of the main guide body; biasing members for urging the roller holders in a closed direction; guide rollers that are rotatably mounted at the extreme ends of the guide rollers and that confront each other; and at least one close limit setting adjustment screws and at least one open limit setting adjustment screws attached to the roller holders for setting a minimum opening and a maximum opening, respectively, between the guide rollers.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The invention will be described in detail with reference to the following drawings in which like reference numerals refer to like elements.

FIG. 8 is a view illustrating arrangement where

DETAILED DESCRIPTION OF PREFERRED EMBODIMENTS

Figure 1:
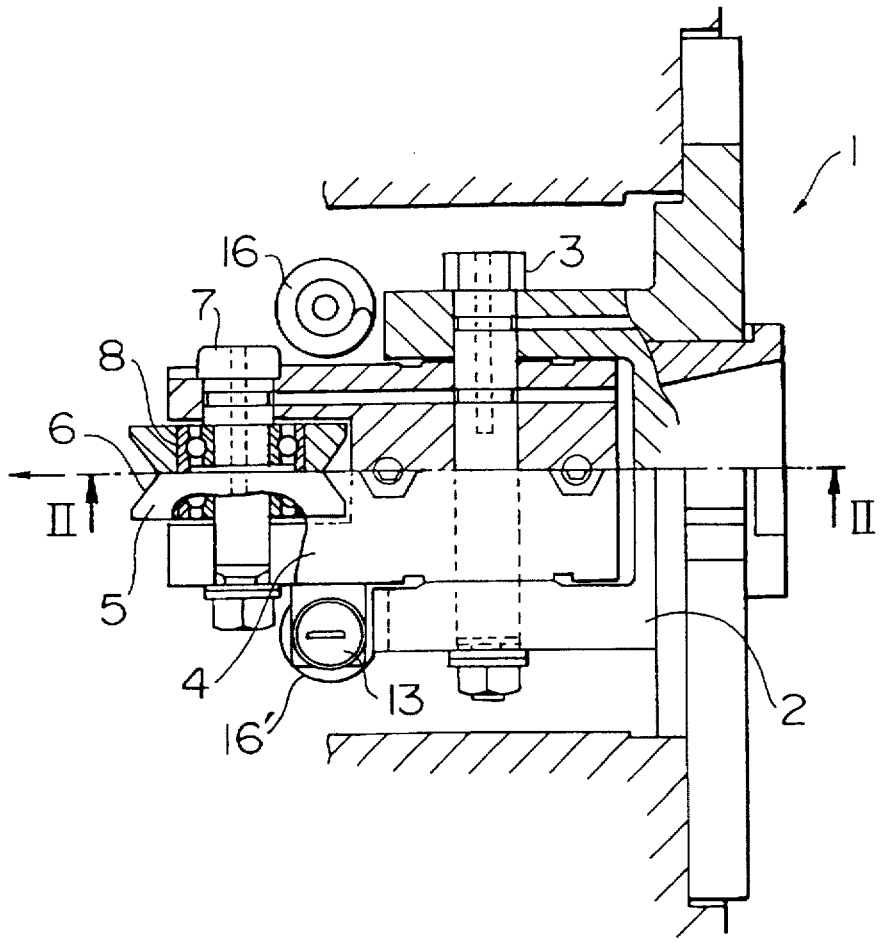
FIG. 1 is a cross-sectional partial view illustrating one preferred embodiment of a round steel bar guide apparatus according to the invention.
Figure 2:
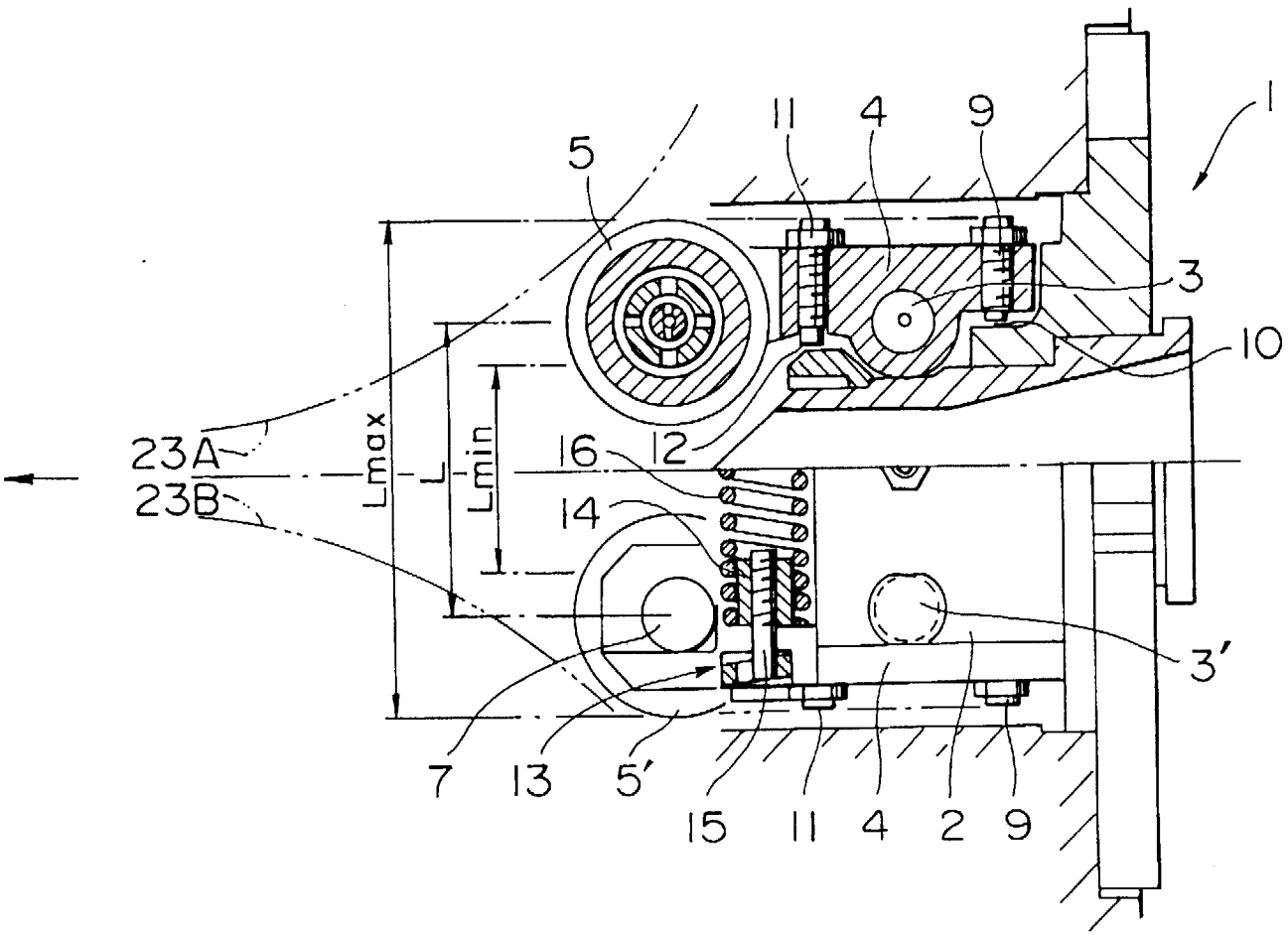
FIG. 2 is a side-elevational view partially in cross section taken along the line II—II of FIG. 1.

A first preferred embodiment of the present invention will be described below with reference to the drawings. FIG. 1 is a cross-sectional partial plan view of a round steel bar guide apparatus 1. FIG. 2 is a side elevational view partially in cross section taken along the line II—II of FIG. 1. The guide apparatus 1 includes roller holders 4, 4', which are swingably supported at the upper and lower sides of an opening of a main guide body 2. The main guide body 2 has a substantially C-shaped cross-section when viewed through pivot pins 3, 3'. The roller holders 4, 4' are symmetrically spaced vertically around the opening of the main guide body 2.

Guide rollers 5, 5' are rotatably mounted at ends of the roller holders 4, 4'. Guide rollers 5, 5' have roller surfaces 6, which each have a V-shaped groove. The V-shaped grooves are positioned to confront each other, and are supported by shafts 7 and bearings 8. A roller distance L is measured between the guide rollers 5, 5', and changes from a maximum distance $L_{max}$ to a minimum distance $L_{min}$ as the roller holders 4, 4' make an upward/downward swinging or seesaw-like motion about the pivot pins 3, 3'.

At least one upper or open limit setting adjustment screw 9 and at least one lower or closed limit setting adjustment screw 11 are threaded in bores in each of the roller holders 4, 4'. The adjustment screws 9 and 10 are positioned on the front and back sides of the rollers holders 4, 4', on sides of the support shafts 3, 3' (FIG. 2). The distance between a screw tip 10 of the upper limit setting adjustment screw 9 and the main guide body 2, against which the screw tip 10 abuts, is adjusted by manually turning the upper limit setting adjustment screw 9. The roller distance L can be adjusted to the maximum distance $L_{max}$ when both the guide rollers 5, 5' are opened.

Likewise, the distance between a screw tip 12 of the lower limit setting adjustment screw 11 and the main guide body 2, against which the screw tip 12 abuts, is adjusted by manually turning the lower limit setting adjustment screw 11. The roller distance L can be adjusted to the minimum distance $L_{min}$ when the both guide rollers 5, 5' are closed.

When the tip 10 of the upper limit setting adjustment screw 9 abuts the main guide body 2, the roller distance between both the guide rollers 5, 5' cannot be further increased. Additionally, when the tip 12 of the lower limit setting adjustment screw 11 abuts the main guide body 2, the roller distance between the guide rollers 5, 5' cannot be further decreased.

Mounting screw adjusting devices 13 are vertically disposed on both the sides of the roller holders 4, 4' in a generally opposite orientation to the guide rollers 5, 5'. A pair of right and left biasing members, for example stretching coil springs 16, 16', are disposed between the mounting screw adjusting devices 13. Mounting screw adjusting devices 13 adjust the length of the coil springs 16 and 16'. These stretching coil springs 16, 16' have a spring constant in a range of generally approximately 5– 100 kgf/mm. A force of each spring 16 and 16' can be adjusted by changing the spring's length advancing or retracting a spring force adjusting screw 15, which is attached to the spring seat 14 of the mounting screw adjusting devices 13. Thus, a round steel bar holding force or press force of the guide rollers 5, 5' can be set to approximately 100–500 kg.

Next, the operation of the invention will now be described. When the guide apparatus 1 is used in a multi-roll sizing mill, such as a four-roll type rolling mill, a strong holding force, is not required for guiding rolling material, such as a round steel bar W. Generally a 1000 kg force would be needed for a conventional two-roll rolling process. However, a force of this nature is not needed with the guide apparatus 1. A sufficient holding force for the guide apparatus 1 is approximately 100–500 kg. If the holding force is less than 100 kg, it will be too small to adequately hold the round steel bar W, and the difference Δd of a diameter of the round steel bar W may be 0.2 or larger. The resulting round steel bar is not acceptable. Conversely, if the holding force is greater than 500 kg, the apparatus itself would have a large size and weight, which is unnecessary. The apparatus becomes uneconomical and impractical to use. Moreover, it is easy to handle and operate a rolling-mill that has the guide apparatus 1.

The biasing member in the form of stretching coil springs 16, 16' urge the roller holders 4, 4' of the guide apparatus 1 to the closed direction, thus obtaining a holding force of 100–500 kg. Even if the diameter of the round steel bar W is changed during rolling, the guide rollers 5, 5' automatically follow the round steel bar's diameter change, expanding and contracting the stretching coil springs 16. Consequently, it is not necessary to manually adjust the distance between the guide rollers 5, 5' with the guide apparatus 1.

The stretching coil springs 16, 16' urge the roller holders 4, 4' in the closed direction, and preferably have a spring constant of approximately 5–100 kgf/mm. When the spring constant is less than 5 kgf/mm, the roller holders 4, 4' cannot obtain a holding force of 100 kg to hold the round steel bar W. If the spring constant is greater than 100 kgf/mm, the holding force is greater than 500 kg. Thus, it is preferable that the spring constant be as small as possible, and have a value of generally approximately 5–50 kgf/mm.

Further, the distance L between the guide rollers 5, 5' of the guide apparatus 1 can be easily manually adjusted with the devices 13 based the diameter of the round steel bar W. The adjusting can occur both prior to rolling and during the rolling process, if the round steel bar diameter changes.

The distance between the guide rollers 5, 5' of the guide apparatus 1 is preset at a lower limit value, which is slightly smaller than a minimum diameter of the round steel bars W to be rolled by adjusting the lower limit setting adjustment screws 11. Next, the lengths for the springs 16, 16', which urge the roller holders 4, 4' in the closed direction, are set to provide a holding force of 100 kg or more to the guide rollers 5, 5'. The springs are set by adjusting the spring force adjusting screws 15 of the mounting screw adjusting devices 13.

When a rolling operation is started, the rolling material, for example a round steel bar W, can be accurately guided to calibers of rolls. The guide apparatus 1 can press and hold the round steel bar W over its entire length with a holding force of 100 kg or more during rolling. Even if the rolling material, such as a round steel bar W, has different diameters, the guide rollers 5, 5' are automatically opened based on the diameter of the round steel bar W. This keeps the predetermined holding force on the round steel bar W, which is achieved by the spring force applied by the stretching coil springs 16, 16'. Therefore, it is unnecessary to stop the rolling operation and adjust the distance between the guide rollers for different sized rolling material.

The holding force for urging the roller holders 4, 4' in the closed direction, which is applied by the stretching coil springs 16, does not exceed 500 kg. Consequently, the rolling material, such as a round steel bar W, will not be damaged by the guide rollers. Further, the guide rollers are not subjected to an excessively large resistances, so a round steel bar pass easily through them without clogging.

In the above described invention, the guide apparatus 1 utilizes springs 16,16' to hold the round steel bar W with a force of generally approximately 100–500 kg. However, this is merely exemplary and the invention is not limited to the above-described configuration. For example, cylinders or the like may be used in place of the springs.

Figure 4:
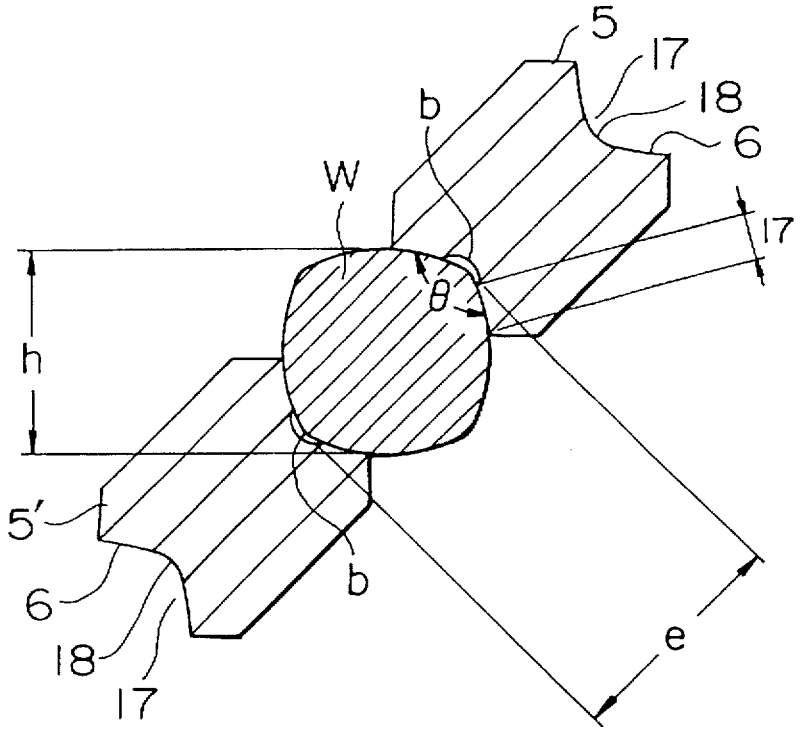
FIG. 4 is a front elevational view illustrating a round steel bar held by a guide apparatus of the invention.

Next, a round steel bar holding method and apparatus for guiding the rolling material, such as a round steel bar W, will now be described. FIG. 4 is a front elevational view of a round steel bar held using the guide apparatus 1. An outer periphery 6 of each of the guide rollers 5, 5' has a V-shaped groove. The V-shaped groove includes a holding surface 17 and an escape groove 18. A free surface "b" of the round steel bar W can be held by the guide rollers 5, 5' at the V-shaped grooves.

Figure 5:
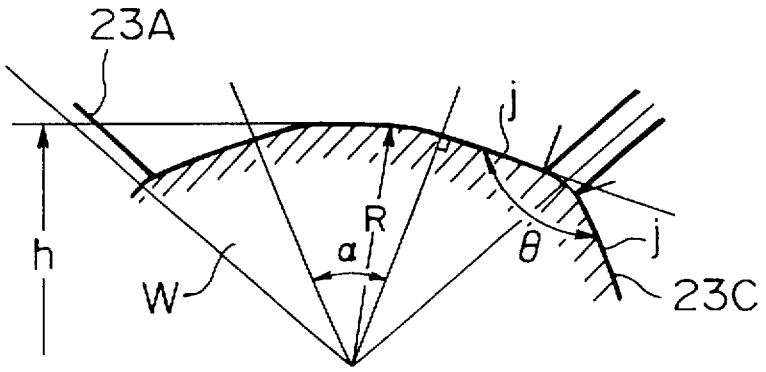
FIG. 5 is a partially enlarged view of a round steel bar rolled by rolls of FIG. 4.

FIG. 5 is a partial view of a rolling material, such as round steel bar W, rolled by rolls 23A–23D. The holding surface 17 of the guide rollers 5, 5' coincides with a linear escape portion "j" of the caliber of the roll 23A, as illustrated in FIG. 5. The holding surface 17 of the guide rollers 5, 5' coincides with a radius R of the caliber of the first path roll 23A. The linear escape portion "j", which is in contact with an arc surface, defines a center angle α. The adjacent linear escape portions "j" of the caliber of the roll 23C defining angle θ.

Thus, even if a distance "h" between the roll 23A in the first path and a confronting roll 23B (not shown) is changed, the angle θ does not change. In other words, even if the distance "e" between the free surfaces "b" of the rolling material, is changed, the relationship between the angle θ and the holding surface 17 is maintained constant.

If the rolling material, such as a round steel bar W, is held by the guide apparatus 1, and is disposed at a roll inlet of the guide rollers 5, 5' as illustrated in FIG. 4, the round steel bar W and the guide rollers 5, 5' do not slip on the holding surface. Thus, the bar round steel bar W can be securely held with only a minimal holding or press force. Even though a twist force on the round steel bar W can be transferred by the radial loads of the guide rollers 1, the twist force is received by thrust forces of the roll shafts. Thus, any loads received by the guide rollers and the roller shafts are reduced, so twisting of the round steel bar W is prevented, and the overall size of equipment is reduced.

Figure 3:
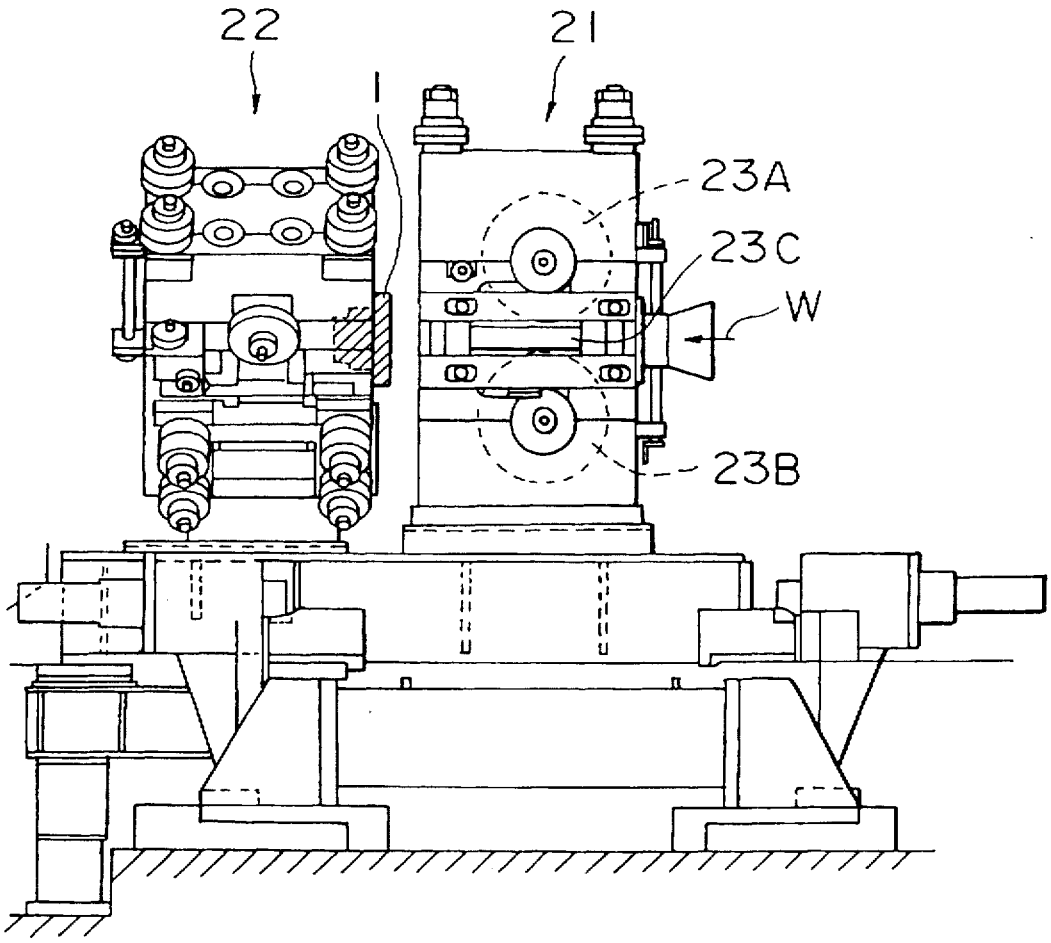
FIG. 3 is an outside view of a four-roll type rolling mill to which the round steel bar guide apparatus of the invention is mounted.

Although the invention is described using two guide rollers, this is merely exemplary and not intending to be limiting. Any suitable structure, for example four guide rollers, may be used. As illustrated in FIG. 3, sets of four-roll type rolling mills are disposed in series at a first stand 21 and a second stand 22 in a rolling mill line.

A rolling experiment was conducted by mounting the guide apparatus 1 at the inlet of the second stand 22, as illustrated in FIG. 3 in phantom. The mills rolled a rolling material, such as round steel bars W. The four-roll type rolling mill at the first stand 21 may be driven for example, by an electric motor, and the four-roll type rolling mill at the second stand 22 may be driven, for example, by a hydraulic motor. The biasing members, such as springs, have a spring constant of approximately generally 30 kgf/mm, and guide rollers apply a press force set of approximately 250 kg. Further, the round steel bar W was held on the free surface "b".

A conventional roller type guide apparatus 30 is mounted at the inlet of a four-roll type rolling mill at the second stand 22 for comparative purposes. The springs therein have a spring constant of approximately generally 1500 kgf/mm. The distance between the guide rollers was manually adjusted based on the diameter of the rolling material.

Sizing was carried out using the rolling mills under the following rolling conditions.

Rolling conditions

| | |
|---|---|
| Type of steel | S45C |
| Rolling temperature | 850–900° C. |
| Round steel bar diameter (mm) | 16–17.5 and 26–28.5 |
| Rolling reduction (mm) | 0.5–3.0 |

Figure 6:
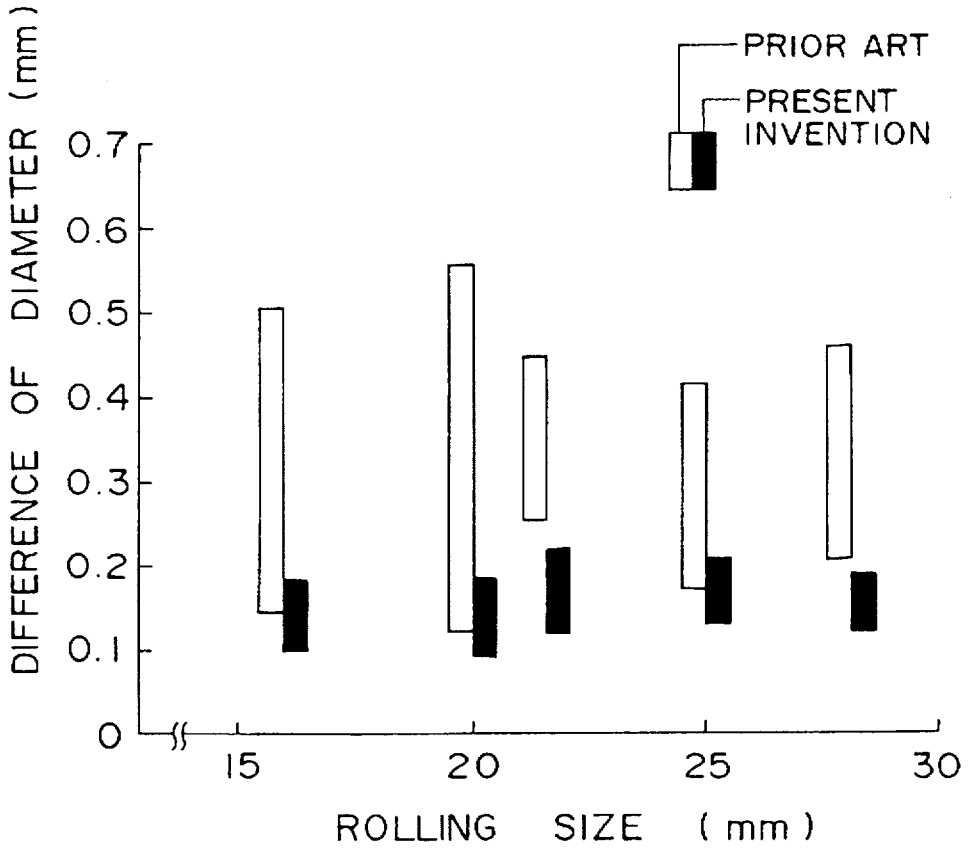
FIG. 6 is a graph illustrating the ratios of round steel bars with a faulty diameter for various rolled sizes.

FIG. 6 shows the results of the comparison of the diameter difference Ad, i.e. Ad=maximum diameter−minimum diameter, from rolling under the above conditions. The guide apparatus 1 had a diameter difference Δd less than about ½ that of the conventional prior art guide apparatus 30. Thus, faulty dimension was prevented and the product could be made with an acceptable and desirable dimensional accuracy by the instant invention.

Although the above example has the guide apparatus 1 at the rolling mill of the second path, this is only exemplary and not meant to be limiting. For example, the guide apparatus 1 may be mounted to the rolling mill of the first path.

In a second preferred embodiment, conditions similar to those of the first preferred embodiment, were provided in the guide apparatus 1. An experiment for comparing rolling of round steel bars W was conducted with a multi-roll type guide apparatus 40 installed at an inlet of the rolling mill in the second path. The press force (kg) for the round steel bars was changed by the guide apparatus 1. The conventional multi-roll type guide apparatus 40 changed the press force on the lower left surface a of the round steel bars W, while the guide rolls 41, 42, 43 and 44 held the round steel bars.

Figure 7:
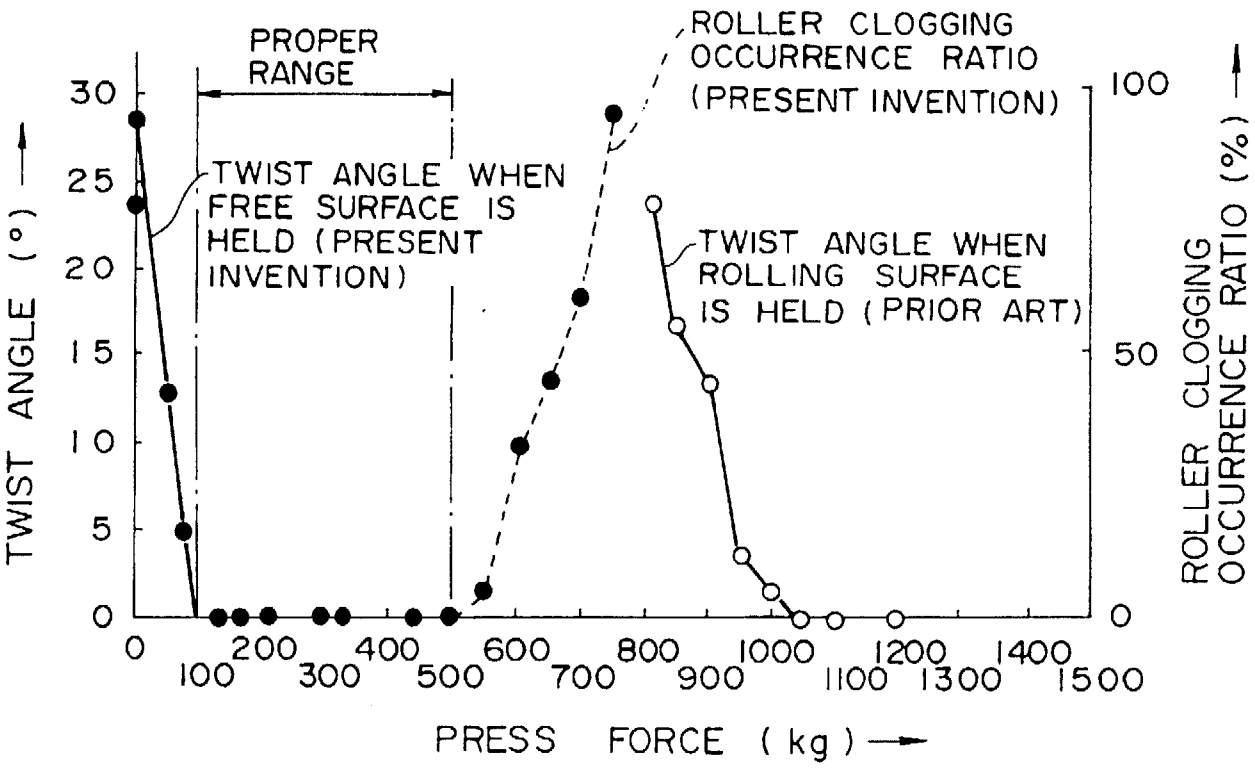
FIG. 7 is a graph illustrating a correlation among a round steel bar holding force, a twist angle of the round steel bar and a roll clogging occurrence ratio.
Figure 8A:
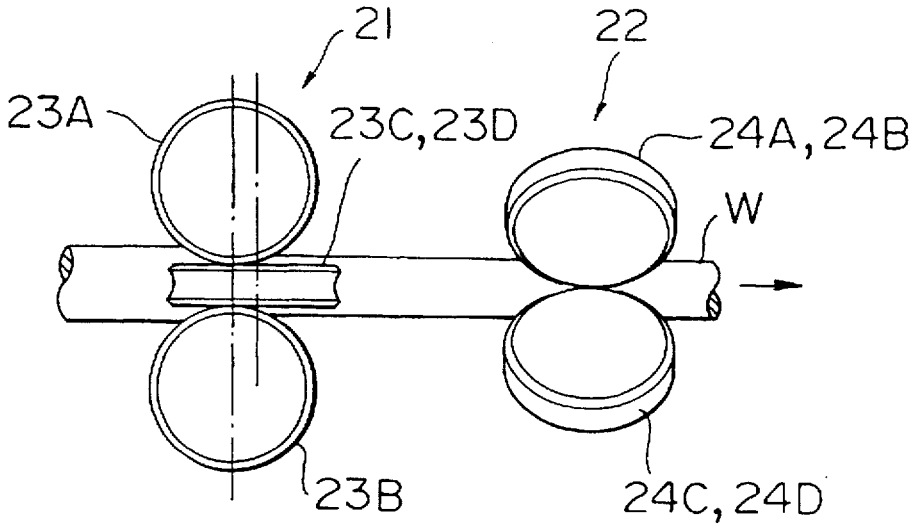
FIG. 8A illustrates a side elevational view of a roll disposition of a four-roll type rolling mill.
Figure 8B:
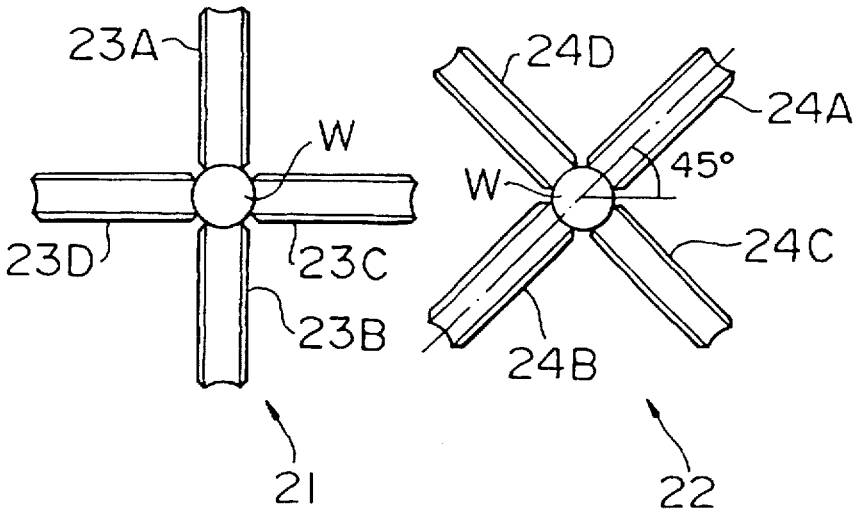
FIG. 8B illustrates a front elevational view of FIG. 8A.
Figure 9A:
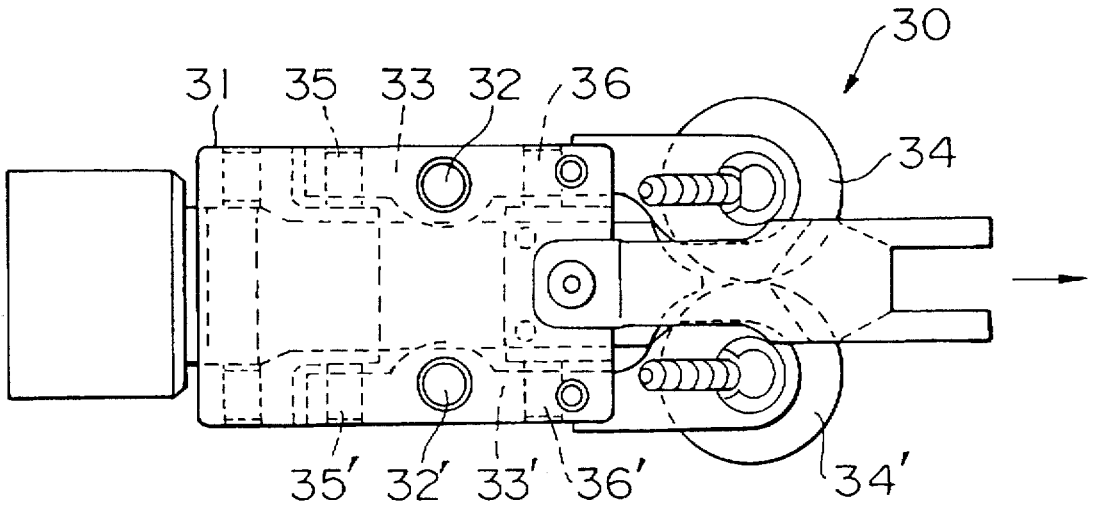
FIG. 9A PRIOR ART
FIG. 9A illustrates a plan view of a conventional round steel bar guide apparatus and FIG. 9B is a side elevational view of FIG. 9A.
Figure 9B:
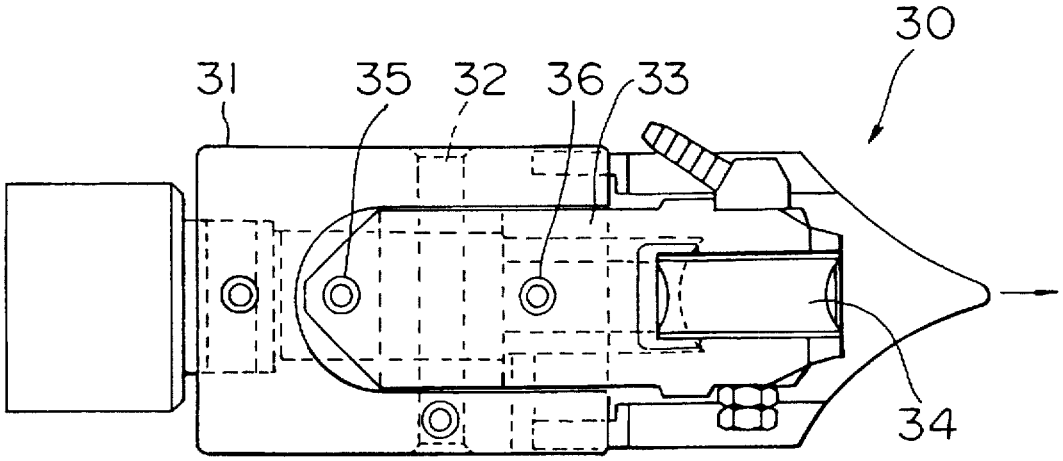
FIG. 9B PRIOR ART
Figure 10A:
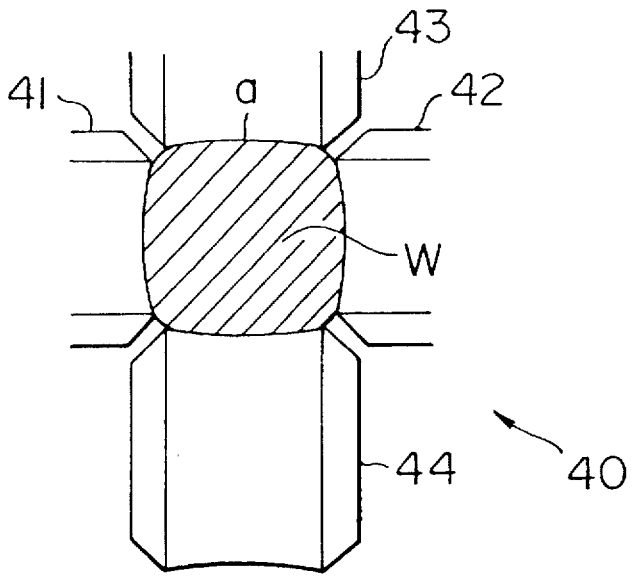
FIG. 10A PRIOR ART
FIG. 10 is a front elevational view illustrating a round steel bar guide apparatus in a conventional multi-roll rolling mill.
Figure 10B:
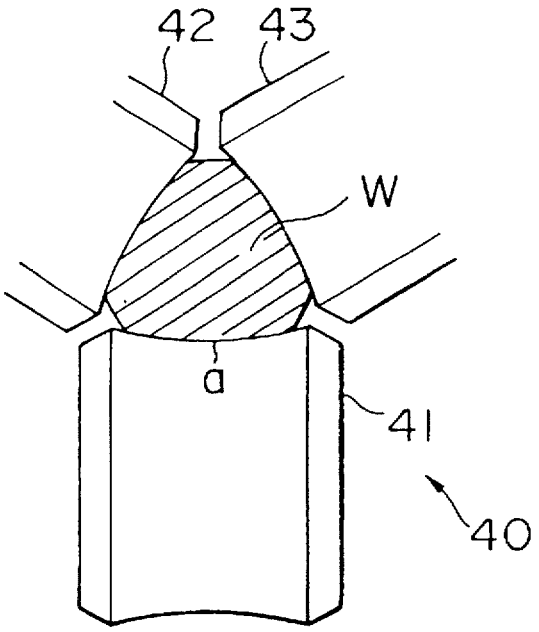
FIG. 10B PRIOR ART

FIG. 7 shows the relationship between a twist angle and roller clogging caused by the applied press force (kg) on the rolling material, such as a round steel bar. ● illustrates the results of rolling the round steel bars W when the guide apparatus 1 holds the free surface "b" of the round steel bars W. ○ illustrates the results of rolling of the round steel bars W when a multi-roll type guide apparatus 40 according to the prior art holds the rolled surface "a" of round steel bars W.

When the press force is less than 100 kg, twist and a faulty dimension occur in the rolling material. Further, when the press force exceeded 500 kg, roller clogging occurred and the round steel bars W were damaged.

With the conventional prior art multi-roll guide apparatus 40, when the press force was equal to or less than 1000 kg, slip occurred on a press surface, and twist resulted. The angle of twist could not become zero, unless the press force exceeded 1000 kg.

According to the round steel bar guide method, a rolling material, such as a round steel bar is pressed and elastically held with a press force of approximately 100–500 kg by the guide rollers 5,5' of the guide apparatus 1. The round steel bar W can be securely prevented from being twisted with only a small amount of a holding force. Thus, the product can be manufactured with an increased dimensional accuracy. Further, rolling error is minimized and the size of the equipment is reduced.

Further, since the apparatus is composed of at least two rollers having roller holders, which are urged in the close direction by springs provided with upper limit setting adjustment screw and lower limit setting adjustment screw for adjusting the roller holders, a round steel bar can be securely held during rolling. Round steel bars of various sizes can be continuously and accurately produced without stopping the rolling operation to adjust the distance between rollers.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes maybe made without departing from the spirit and scope of the invention as defined in the following claims.

What is claimed is:

1. A method for guiding rolling material of various sizes to calibers of rolls while holding the rolling material by a guide apparatus, wherein the guide apparatus comprises guide rollers installed at an inlet of at least one of a plurality of multi-roll sizing mills disposed in a line, a stand of each sizing mill comprising at least three rolls, the method comprising the steps of:

elastically holding a free unrolled surface portion of said rolling material with a press force in the range of approximately 100 to 500 kg; and sizing the rolling material.

2. A method according to claim 1, wherein the method further comprises:

elastically holding said rolling material by said guide rollers, and urging the guide rollers in a closed direction by springs.

3. A method according to claim 1, wherein the method further comprises:

elastically holding said rolling material by said guide rollers; and urging the guide rollers in a closed direction by cylinders.

4. A method according to claim 1, wherein the rolling material is a round steel bar.

5. A method according to claim 1, wherein the step of elastically holding includes biasing members urging the guide rollers.

6. A round steel bar guide apparatus for guiding rolling material of various sizes to calibers of rolls of at least one sizing mill of a plurality of multi-roll sizing mills disposed in series, a stand of said at least one sizing mill being composed of at least three rolls, the guide apparatus being installed at an inlet of said stand and comprising:

a main guide body having a substantially C-shaped cross section and an opening;

at least two roller holders swingably held at opposed portions of the opening of said main guide body;

at least two biasing members that urge said at least two roller holders in a closed direction;

at least two guide rollers rotatably mounted on said at least two roller holders so as to confront each other and provide a press force of about 100 to 500 kg to the rolling material; and at least one closed limit setting adjustment screw and at least one open limit setting adjustment screw operably connected to at least one of said two roller holders, said at least one closed limit setting adjustment screw setting a minimum opening between said at least two guide rollers and said at least one open limit setting adjustment screw setting a maximum opening between said at least two guide rollers.

7. A guide apparatus according to claim 6, wherein each said biasing member comprises a mounting screw adjusting device, said mounting screw adjustment device including a spring seat being connected to an end of a spring and a spring adjusting screw being threaded with said screw seat.

8. A guide apparatus according to claim 6, wherein said spring has a spring constant in the range of approximately 5 to 100 kgf/mm.

9. A guide apparatus according to claim 6, wherein each said guide roller includes an outer peripheral shape having a V-shaped groove.

10. A guide apparatus according to claim 6, wherein each guide roller of said at least two guide rollers is inclined 45° with respect to a rolling direction at a front stage of said at least one sizing mill.

11. A guide apparatus according to claim 6, wherein the rolling material is a round steel bar.

12. A guide apparatus according to claim 6, wherein said at least one closed limit setting adjustment screw and said at least one open limit setting adjustment screw are operationally connected to respective ones of said at least two roller holders.

13. A guide apparatus according to claim 6, wherein said at least two guide rollers are mounted at ends of said at least two roller holders.

14. A guide apparatus according to claim 9, wherein each of said at least two rollers is inclined 45° with respect to a rolling direction of said at least one sizing mill.

15. A method for guiding rolling material of various sizes to calipers of rollers while holding the rolling material by a guide apparatus, wherein the guide apparatus comprises a main guide body having a substantially C-shaped cross-section and an opening, at least two roller holders swingably held at upper and lower portions of the opening of said main guide body, at least two biasing members that urge said at least two roller holders in a closed direction, at least two guide rollers rotatably mounted at extreme ends of said at least two roller holders so as to confront each other, and at least one closed limit setting adjustment screw for setting a minimum opening between said at least guide rollers and at least one open limit setting adjustment screw for setting a maximum opening between said at least two guide rollers, the method comprising the steps of:

elastically holding a free unrolled surface portion of said rolling material with a press force in the range of approximately 100 to 500 kg; and sizing the rolling material.

16. A method according to claim 15, wherein the rolling material is a round steel bar.

17. A method according to claim 15, wherein at least two closed limit setting adjustment screws and at least two open limit adjustment screws are provided, one of each being operationally connected to respective ones of said at least two roller holders.

18. A method according to claim 15, wherein the step of elastically holding is performed by biasing members urging the guide rollers together.

19. A method according to claim 15, wherein said step of elastically holding said rolling material is performed by said guide roller and said guide rollers are urged in a closed direction by springs.

20. A method according to claim 15, wherein the step of elastically holding aid rolling material is performed by said guide rollers and said guide rollers are urged in a closed direction by cylinders.

* * * * *

UNITED STATES PATENT AND TRADEMARK OFFICE

CERTIFICATE OF CORRECTION

PATENT NO. : 5743127

DATED : April 28,1998

INVENTOR(S) : Ryo Takeda et al.

It is certified that error appears in the above-identified patent and that said Letters Patent is hereby corrected as shown below:

Claim 1, line 1, after "guiding" insert --highly round--;
line 2, before "to" insert --along a highly straight path--;
line 11, after "material" insert --using said at least one sizing mill, said stand comprising at least three rolls producing a highly round rolling material that travels along a highly straight path--.

Claim 6, line 1, after "guiding" insert --highly round--;
line 2, after "sizes" insert --along a highly straight path--;
line 5, after "rolls" insert --so as to produce a highly round rolling material that travels along a highly straight path--;
line 24, after "rollers" insert --,said guide rollers being elastically biased to accommodate various sized rolling material within constraints of the open limit setting adjusting screw and the closed limit setting adjusting screw while maintaining a substantially constant press force--.

Claim 15, line 1, after "guiding" insert --highly round--;
line 2, before "to" insert --along a highly straight path--; change "calipers" to --calibers--;
line 19, after "material" insert --using at least one sizing mill having a stand comprising at least three rolls, thereby producing a highly round rolling material that travels along a highly straight path--.

Signed and Sealed this

First Day of September, 1998

Bruce Lehman

*Attest:*

BRUCE LEHMAN

*Attesting Officer*

*Commissioner of Patents and Trademarks*